US006461192B1

(12) United States Patent
Kwoka

(10) Patent No.: US 6,461,192 B1
(45) Date of Patent: Oct. 8, 2002

(54) BREAKAWAY CABLE CONNECTOR

(75) Inventor: Paul J. C. Kwoka, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/843,785

(22) Filed: Apr. 30, 2001

(51) Int. Cl.[7] ..... H01R 11/00
(52) U.S. Cl. ..... 439/505; 439/923
(58) Field of Search ..... 439/638, 500–505, 439/923; 273/148; 463/1, 35, 30

(56) References Cited

U.S. PATENT DOCUMENTS 4,077,690 A * 3/1978 Koether ..... 439/320
5,462,452 A * 10/1995 Devine ..... 439/505
5,516,105 A * 5/1996 Eisenbrey et al. ..... 273/148 B
5,540,601 A * 7/1996 Botchek ..... 439/502
5,573,425 A * 11/1996 Morisawa et al. ..... 439/502
5,697,810 A * 12/1997 Barry ..... 439/503
5,941,729 A * 8/1999 Sri-Jayantha ..... 439/505
6,007,373 A * 12/1999 Chew ..... 439/504
6,062,910 A * 5/2000 Braquet et al. ..... 439/578

* cited by examiner

*Primary Examiner*—Renee Luebke
*Assistant Examiner*—Briggitte R. Hammond
(74) *Attorney, Agent, or Firm*—Banner & Witcoff, Ltd.

(57) ABSTRACT

A cable, including first and second lengthwise portions that are coupled by an axially engageable safety breakaway connector, is used to connect first and second components. If someone trips on the cable, a region of the cable adjacent to the breakaway connector is pulled taut. Therefore, a substantially linear tensile force is applied to the cable at the breakaway connector. This tensile force is preferably sufficient to cause the respective parts of the breakaway connector to decouple instead of, for example, jerking one or both of the first and second components in a potentially damaging manner. For example, the cable may be used to connect an electronic game console with a game controller unit. Thus, if a person or pet trips over the cable, the cable becomes decoupled at the breakaway connector before the game console (which is commonly heavy and/or expensive) is jerked to the ground.

22 Claims, 8 Drawing Sheets

BREAKAWAY CABLE CONNECTOR

FIELD OF THE INVENTION

The present invention relates to a cable for connecting electronic components that includes first and second lengthwise portions connected by a breakaway or otherwise selectively releasable connector.

BACKGROUND OF THE INVENTION

It is generally known to electrically connect electronic components with an electrical cable, such as a signal-carrying cable. For example, an audio speaker is connected to a stereo receiver by a speaker cable. Also, a computer mouse and a printer are connected to a computer by respective cables. Furthermore, an electronic game console is connected to one or more game controller units by respective cables.

For example, FIG. 1 is a plan view of an electronic system 100 including a main console 102, an input/control device 104, and a cable 106 electronically connecting main console 102 and input/control device 104. FIG. 1 illustrates main console 102 resting on a support surface, such as a table or shelf or the like 108.

Cable 106 is frequently quite long in order, for example, to offer more freedom of movement and placement between the main console 102 and input/control device 104. For example, in an electronic game system such as a video game system, the input/control device 104 may be a game controller unit, and main console 102 may be a video game console connected to the game controller unit by a long length of cable 106 so that a game player can, for example, sit comfortably several feet away from the game display.

However, a problem occurs because an individual, a dog, a cat, or other pets can trip over cable 106. Also, a pet may chew on and pull at cable 106. In addition, from time to time, an individual may, without thinking carefully, try to tug on cable 106 to disengage it from, for example, main console 102. In each of these cases, there is a danger that one or both of the main console 102 and input/control device 104 may be pulled by the force of, for example, tripping on, pulling on, or otherwise yanking on the cable 106. This can cause main console 102 (which is commonly heavy, fragile, and/or expensive) to fall from its location onto the floor and become damaged or cause damage or injury.

For example, FIG. 2 illustrates the system 100 as in FIG. 1 in a situation where a generally transverse (with respect to a direction between input/control device 104 and main console 102) force F is exerted on cable 106, as when someone trips over cable 106. In this case, cable 106 impulsively is bowed out to one side (as shown in phantom at 106' in FIG. 2). Cable 106 is conventionally fixedly connected to main console 102 at attachment location 110. In other instances, cable 106 is detachably connected to main console 102 where attachment location 110 is a plug received in a socket (not shown) provided in main console 102. A conventional plug may simply be axially insertable into a receptacle along an insertion direction. The plug may additionally snap into permanent or temporary engagement with main console 102, or it may be selectively locked in engagement by, for example, a spring clip, a locking pawl, screw or other fasteners, or by a threaded engagement between the plug and main console 102.

In any event, the manner in which cable 106 is conventionally connected to main console 102 causes a problem because the conventional connections resist or even prevent disengagement when cable 106 experiences a force F as shown. Even if cable 106 is simply axially inserted as a plug at location 110, the deflection of cable 106' causes an off-axis (i.e., oblique to the plug insertion direction) force component on the plug, which may, for example, cause respective surfaces of the plug and receptacle to press harder against each other, thereby increasing frictional resistance to disengagement in a known manner.

As a result, the tension in cable 106 caused by force F may pull on main console 102 strongly enough to pull it out of its place on table 108, as seen in FIG. 3. If main console 102 is pulled out of place far enough, main console 102 can even fall off of table 108, thereby causing damage and/or injury. On the other hand, if the console 102 is restrained, the force F may result in damage to the console 102 and/or the plug at location 110 where they are connected.

SUMMARY OF THE INVENTION

The present invention is therefore generally directed to a cable including a first lengthwise portion connected to a second lengthwise portion by a breakaway connector located closer to one end of the cable than the other end of the cable. That is, the first and second lengthwise portions are different lengths with respect to each other. The first and second lengthwise portions of the cable are characteristically separable from each other by applying a linear pulling force to one or both of the first and second lengthwise portions so as to separate the breakaway connector. The breakaway connector allows the cable to separate at the breakaway connector if, for example, an individual trips over the cable and avoids jerking a component connected to the cable out of place (which can cause the component to fall to the ground or cause damage to the connection between the cable and the component).

The connecting force at the breakaway connector is preferably only a function of cooperative frictional effects. One example of a breakaway connector according to the present invention is a male-female connector including one or more male parts cooperating with a corresponding number of female parts.

An end of the cable (i.e., an end of one of the lengthwise portions opposite the breakaway connector) may be connected to the component by more rigid methods, such as, without limitation, clip locks, threaded connectors, screw fasteners, resiliently mounted pawls, etc. which generally resist disengagement between the component and the cable.

Most generally, the present invention relates to an arrangement wherein a component is connected by a signal-carrying cable and/or a power-carrying cable to another location, where the cable is susceptible to being tripped over or otherwise unintentionally pulled on in a way that may cause the component to move out of place in a manner that could cause damage to the component or cause injury or damage.

More particularly, the present invention relates to an arrangement in which two components are connected to each other by a cable, again, where the cable is susceptible to being tripped over or otherwise unintentionally pulled on. In one example of the present invention, a cable as described above is used to connect an electronic game system console with a game controller unit. In another example of the present invention, a cable as described above is used to connect a main processor console in an electronic information processing system and a user input unit. For example, the electronic information processing system is a computer, and the input unit is a computer pointing device, such as, without limitation, a computer mouse, a trackball, a joystick, a yoke controller, a touch-sensitive tablet, or a digital camera. Another example is a video camera connected to a video recorder.

BRIEF DESCRIPTION OF THE DRAWINGS

The present invention will be even better understood with respect to the appended drawings, in which.

DETAILED DESCRIPTION OF THE INVENTION

As mentioned above, the present invention is most generally related to a component connected by a cable to another location, including, without limitation, to another component. Strictly for the purpose of illustration, an example of main console and an input/control device connected by a cable will be discussed hereinbelow, without in anyway intending to limit the invention as set forth in the appended claims.

Figure 1:
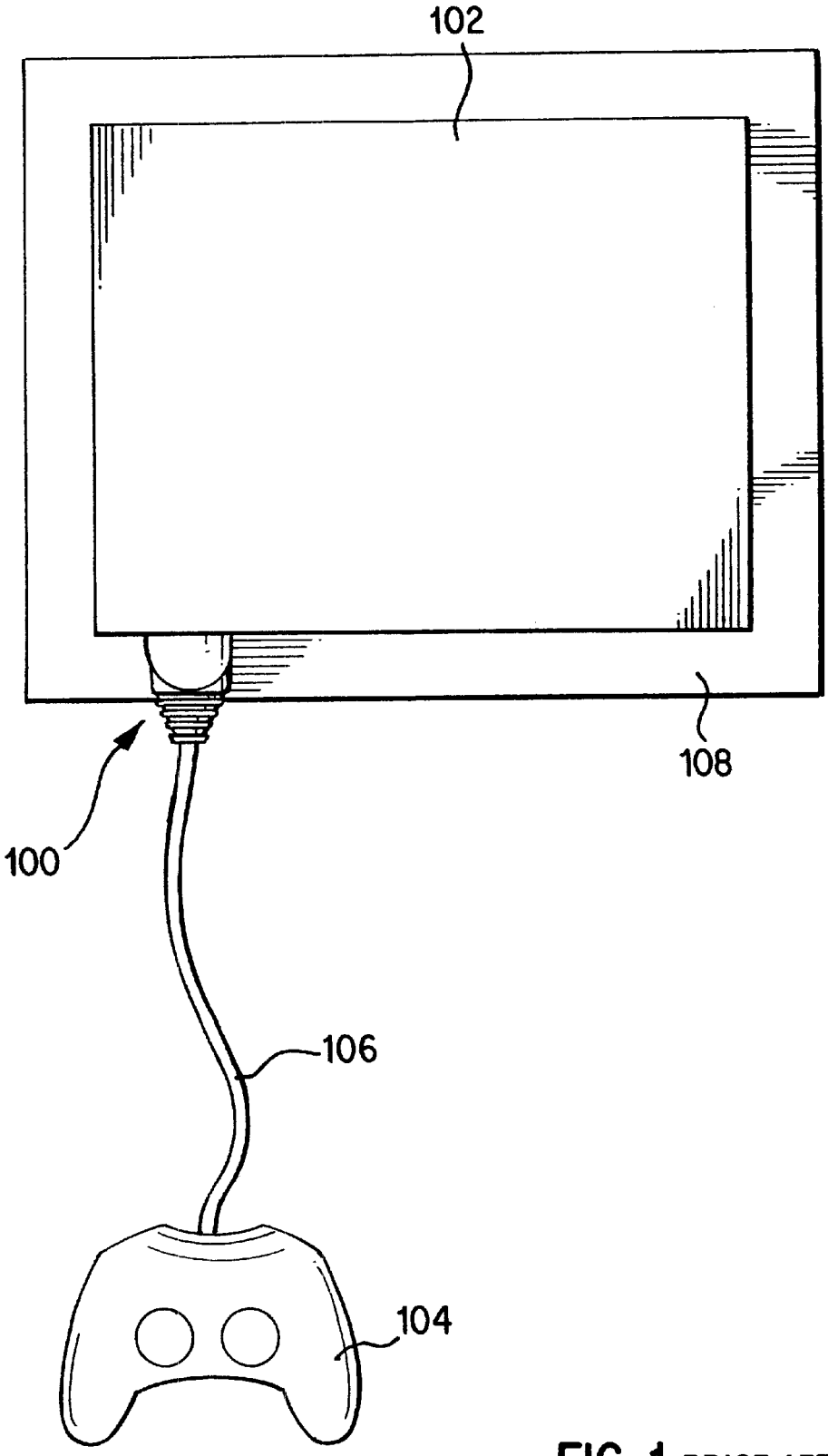
FIG. 1 PRIOR ART
FIG. 1 is a plan view of a conventional electronic system including a main console and a peripheral input device connected to the main console by a cable.
Figure 4:
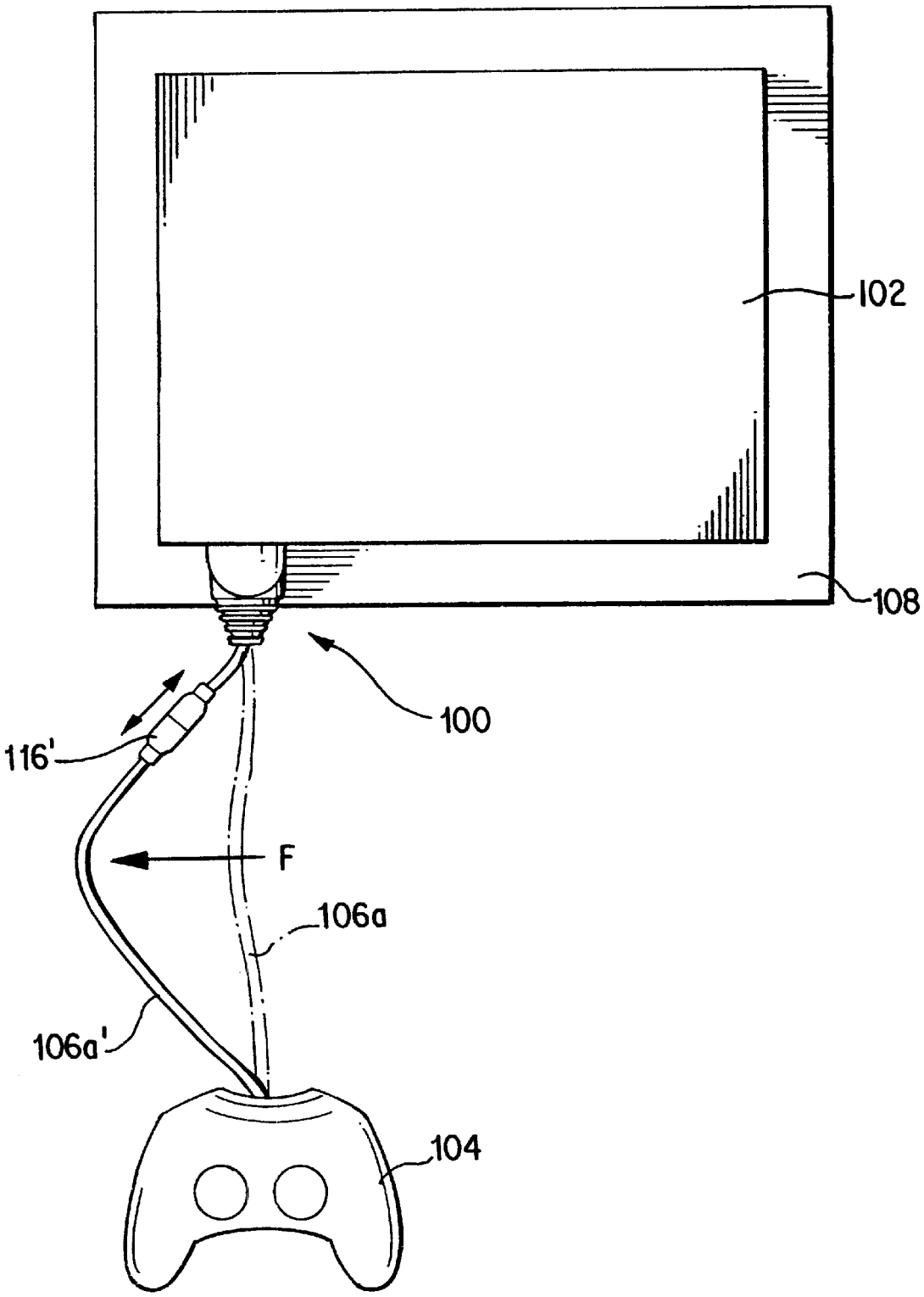
FIG. 4 is a plan view illustrating the use of a cable including a breakaway male-female connector in accordance with the present invention.

Thus, an electronic system 100 is illustrated in FIG. 4. System 100 includes a main console 102 and an input/control device 104 connected to main console 102 by a flexible cable 106*a*. In operation, the input/control device 104 preferably can send at least a control signal to main console 102 by way of cable 106*a*. FIG. 1 is a plan view of system 100, wherein main console 102 is resting on a work surface 108, such as, without limitation, a bookshelf, a table, a desk, or a support stand. A user may operate or otherwise manipulate the input/control device 104 at a location remote from main console 102, depending on a length of cable 106*a*.

Cable 106*a* includes a first lengthwise portion 112 and a second lengthwise portion 114, connected together by a breakaway connector 116. An example of a breakaway connector according to the present invention is a male-female connector. A male-female connector is expressly meant to refer to any connector that relies on axial insertion of a male part into a female part to establish a connector, including, without limitation, male-female pin connectors, male-female plugs and receptacles, and male-female flat connectors and receptacles. The characteristic feature of a male-female connector of this type is that the respective male and female parts of the connector are engageable by pressing the respective parts together axially and are disengageable by only pulling on the respective parts, relative to each other. This feature will be discussed further hereinbelow.

While the first lengthwise portion 112 and the second lengthwise portion 114 are joined at respective ends thereof at the breakaway connector 116, the first lengthwise portion is coupled at its end opposite the breakaway coupling 112 to main console 102 (or to another electrical housing). The coupling between first lengthwise portion 112 and main console 102 is preferably a connector coupling. The connector coupling is preferably an "on-axis" connector in an exemplary embodiment. In an "on-axis" connector, a sufficient pulling force (on the cable or on the connector) along the direction of the connector axis will cause the connector to separate from the console. On the other hand, a pulling force (on the cable or on the connector) that deviates or is skewed from the connector axis by an angle of more than a few degrees (i.e., an "off-axis" force) will not separate the connector from the console. Accordingly, an off-axis force on the cable will be transferred to the console itself.

The end 119 of the second lengthwise portion 114 may, for example, by fixedly attached to input/control device 104.

Cable 106*a* contains any known electrical conductors necessary for the connection between main console 102 and input/control device 104, including, for example and without limitation, one or more conductors for carrying power, unidirectional signal traffic, and/or bidirectional signal traffic.

Main console 102 can be a variety of known or novel electronic components, including, without limitation, an electronic processor console such as a computing device, an electronic video game console, or other electronic component such as, without limitation, a camcorder, a stereo component, or a video display. Input/control device 104 can also be a variety of known or novel electronic components including, without limitation, a video game system controller, a computer input device such as a keyboard, a joystick, a game yoke, a computer mouse, a trackball, or a touch-sensitive tablet, or a video camera.

Figure 2:
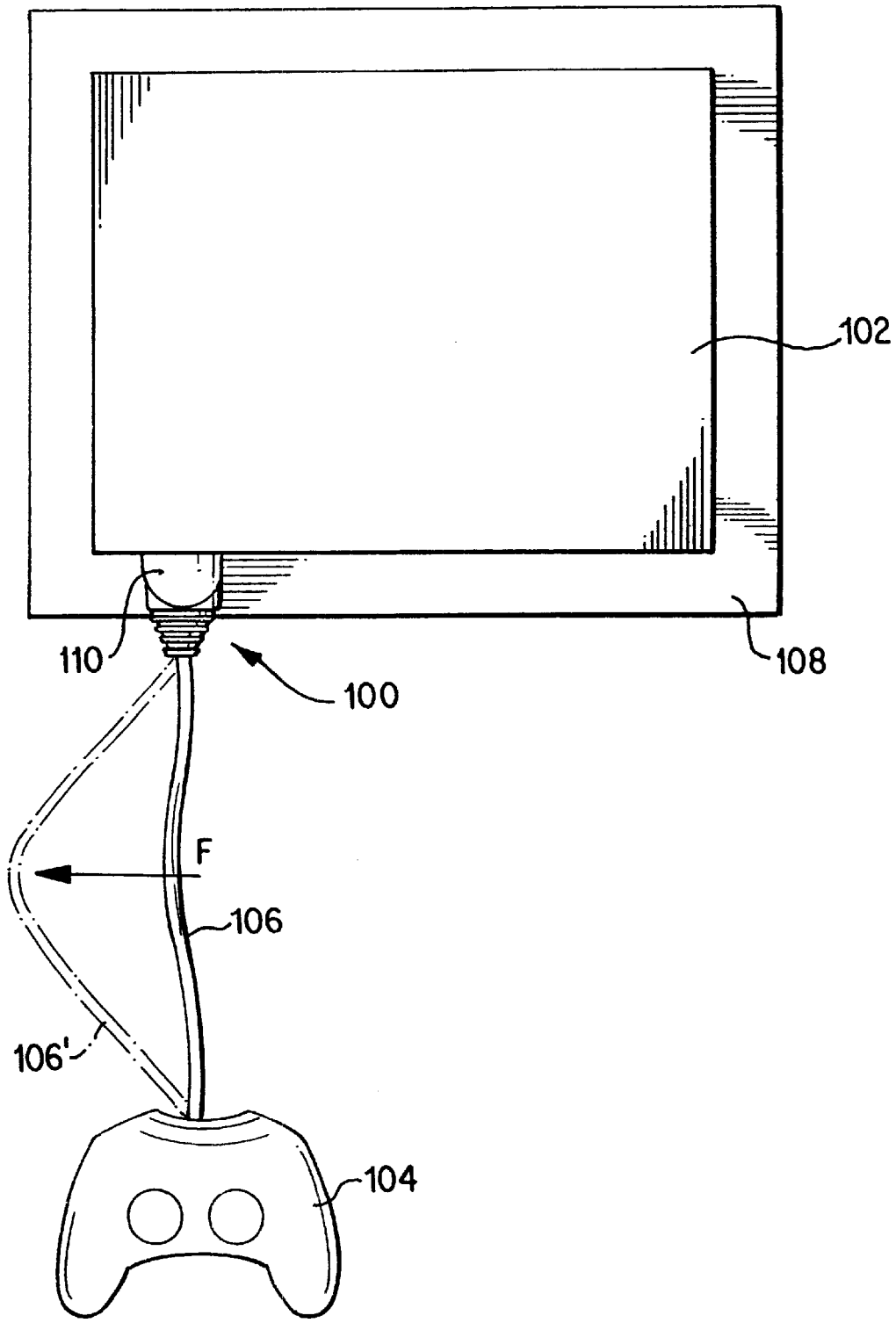
FIG. 2 PRIOR ART
FIG. 2 is a plan view of the conventional system illustrated in FIG. 1, illustrating the application of a sudden transverse force on the conventional cable, such as that which would occur if a person tripped on the cable.

FIG. 4 is somewhat similar to FIG. 2, illustrating the application of a generally transverse (i.e., with respect to a direction extending between input/control unit 104 and main console 102) force F on cable 106*a*. Such a force is imparted, for example, when a person trips on cable 106*a*.

Figure 5:
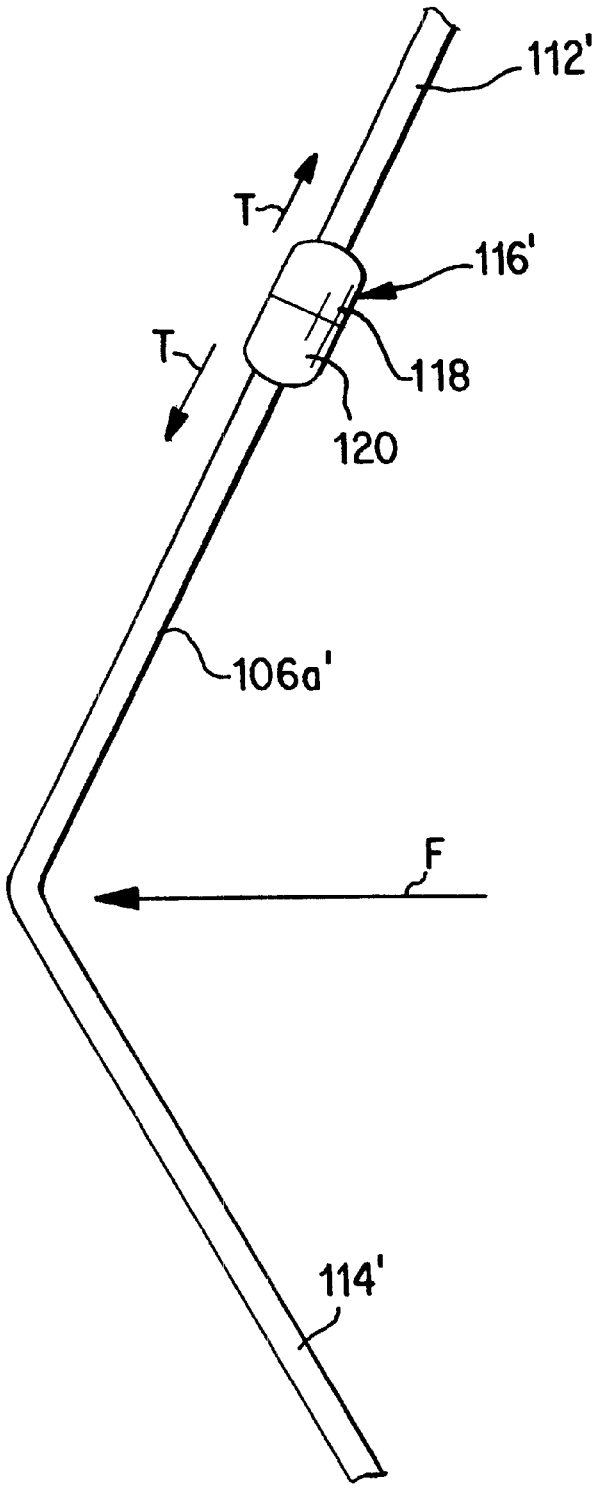
FIG. 5 is an enlarged partial view of cable including the male-female connector according to the present invention, including the local tension forces applied to the male-female connector.

Cable 106*a* is pulled in the direction of force F, as seen in phantom at 106*a*'. As can be seen in FIG. 4, this deflection of cable 106*a*' causes at least a portion of cable 106*a*' adjacent to connector 116' to become substantially taut because the respective ends of cable 106*a*' are generally stationary. Therefore, connector 116' (i.e., connector 116 under tension caused by force F) experiences oppositely directed tension forces T along cable 106*a*' as seen in FIG. 5.

Figure 3:
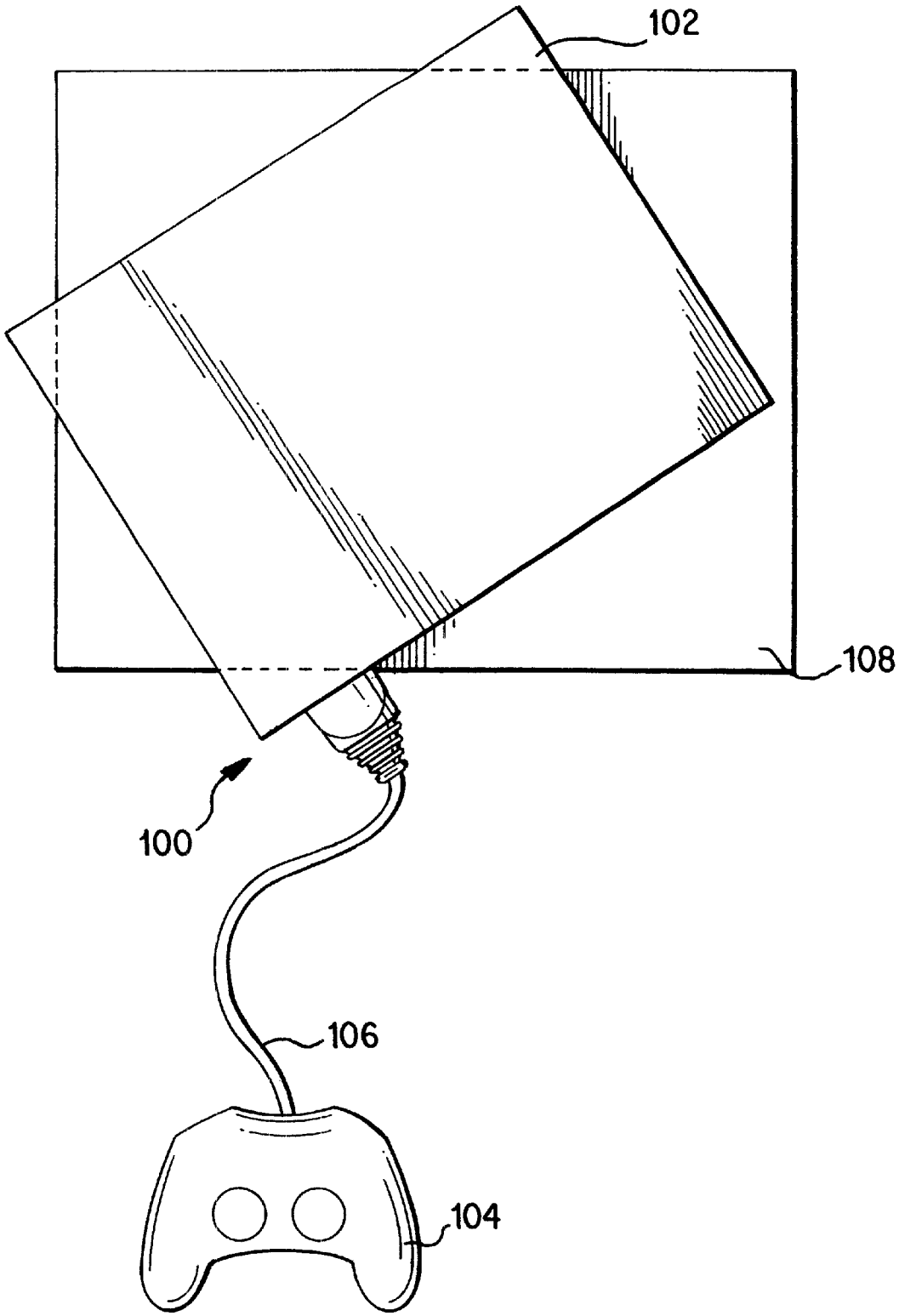
FIG. 3 PRIOR ART
FIG. 3 is a plan view of the conventional system illustrated in FIGS. 1 and 2, illustrating how the main console can be jerked out of place by the sudden force applied to the cable.

The constituent parts 118 and 120 of connector 116(116') preferably disengage or break away from each other under an axially applied tension T so as to release the tension in cable 106*a*(106*a*), and prevent main console 102 from being pulled out of place or off of work surface 108, as was illustrated in FIG. 3 with respect to the conventional art.

In one example of the present invention, the connector 116(116') is located within about 30 cm of the end of cable 106*a*(106*a*') connected to the main console 102. In a particular example of the present invention, the connector 116(116') is located within about 5 cm to about 18 cm of the end of the cable connected to the main console 102.

Furthermore, in one example of the present invention, the connector 116(116') is located less than about 10% of the total length of cable 106*a* away from a respective end of cable 106*a*(106*a*'). Therefore, if cable 106*a*(106*a*') is about 3 m long, the connector 116(116') may be located, for example, within about 30 cm from an end of the cable 106*a*(106*a*'). Locating the connector 116(116') along the cable 106*a*(106*a*') in this manner helps to ensure that the cable 106*a*(106*a*') will be assuredly pulled taut in a manner that will cause a local region of the cable adjacent to connector 116(116') to become taut and apply tension T thereto, thereby separating the parts of connector 116.

Figure 6:
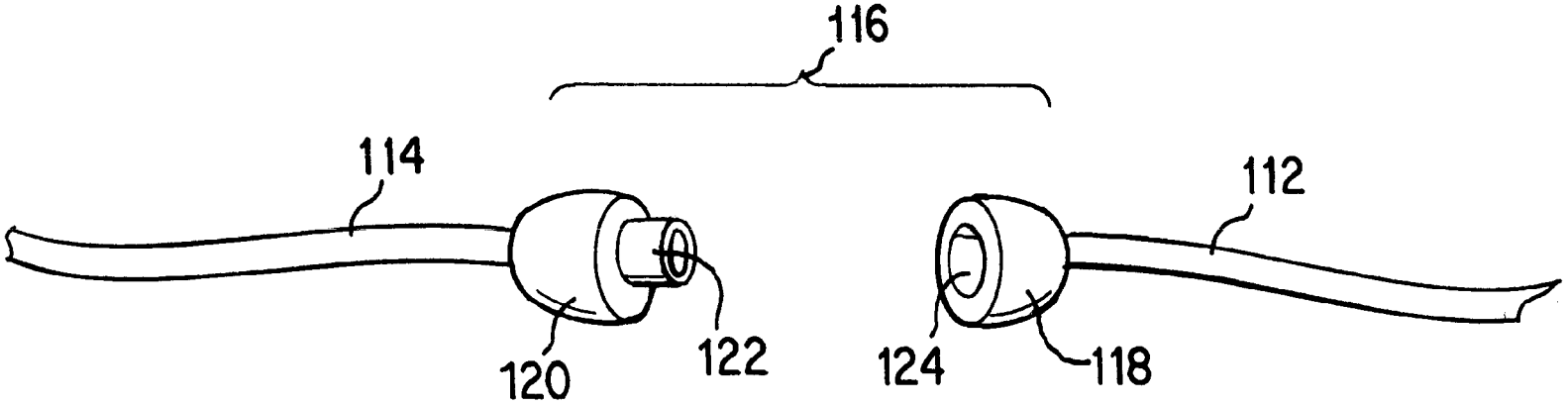
FIG. 6 schematically illustrates one example of the parts of the male-female connector according to the present invention.

FIG. 6 illustrates a general example of the parts 118 and 120 of connector 116. For example, first lengthwise portion 112 of cable 106 may include a first or female part 118 including a receiving bore 124 formed therein in a known manner. The second lengthwise portion 114 of cable 106 includes a second or male part 120 including a protruding portion 122 that is received in bore 124 to establish an electrical connection between first and second lengthwise portions 112 and 114. As mentioned above, the structure and orientation illustrated in FIG. 6 is strictly by way of example, and the present invention contemplates male-female parts and other mating parts having a variety of known structures, including those mentioned above. Furthermore, the male part 120 could alternatively be provided on first lengthwise portion 112 while the female part 118 could be provided on the second lengthwise portion 114 in accordance with the present invention. Generally, connector 116 is preferably an "on-axis" connector in accordance with the explanation of the term "on-axis" set forth above.

Figure 7:
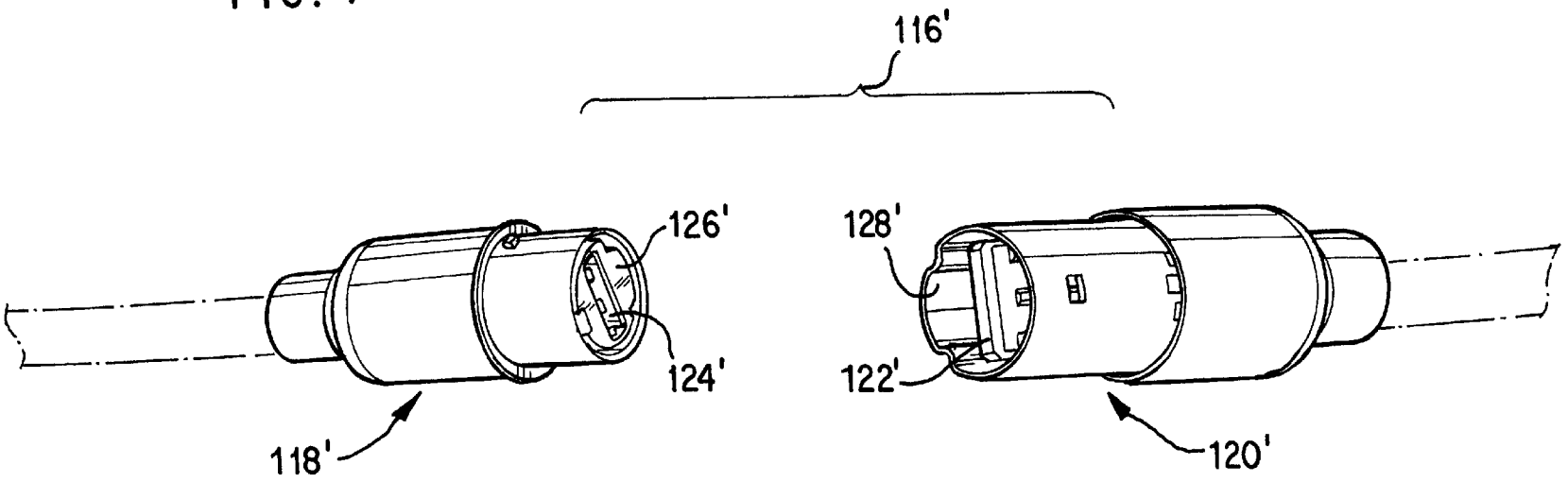
FIG. 7 illustrates another example of the parts of the male-female connector according to the present invention.

FIG. 7 is a perspective view of an example of male and female parts of a connector 116' usable in accordance with the present invention. For example, female part 118' includes a slot 124' formed therein, whereas male part 120' includes a flat protruding portion 122' formed therein. Slot 124' is sized and shaped to frictionally receive protruding portion 122' when female part 118' and male part 120' are connected. Protruding portion 122' and slot 124' each include a predetermined arrangement of conductive portions thereon and therein, respectively, that cooperate during engagement to form one or more electrical connections as may be required. The arrangement of the respective conductive portions may vary widely in accordance with given operational requirements. Female part 118' and male part 120' may, if desired or if necessary, by "keyed" to each other, or otherwise include additional alignment structures. For example, female part 118 may include a solid ridge 126' shaped to cooperate with a groove 128' located in male part 120' in order to ensure that protruding portion 122' is not inserted into slot 124' "upside-down."

Figure 8:
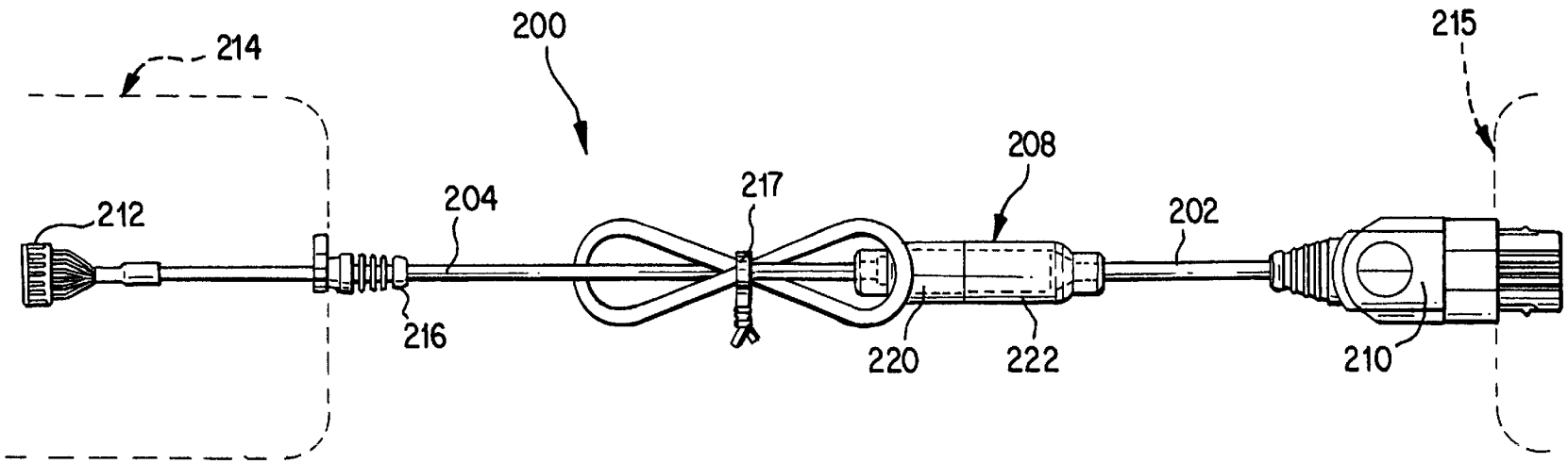
FIG. 8 illustrates one example of a cable according to the present invention.

FIG. 8 illustrates a cable 200 in accordance with the present invention. Cable 200 includes a first lengthwise portion 202 and a second lengthwise portion 204. First and second lengthwise portions 202, 204 are connected to each other by a breakaway connector 208 having mating parts 220 and 222 formed in accordance with the foregoing description. At a first end of cable 200, a first device connector 210 is provided, and at a second end of cable 200 a second device connector 212 is provided. Cable 200 may, for example, be a cable connecting a game controller unit 214 (partially and schematically shown in phantom in FIG. 8) and a game console 215 (partially and schematically shown in FIG. 8). FIG. 8 illustrates a cable 200 as a coiled bundle tied by a retainer (such as a twist tie 217), and this representation should be interpreted as indicating that any desired length of cable 200 can be used in accordance with the present invention. First device connector 210 may therefore be a plug that is receivable in an appropriate socket of the game console. Second device connector 212 may be, for example, a pin connector receivable in a connector located on a circuit board (not shown) in game controller unit 214 in a known manner. A conventionally known cable strain relief structure 216 can be located at the point at which cable 200 exits game controller unit 214, in order to protect the cable against bending and flexing strain.

It is emphasized that the first and second device connectors shown here are strictly examples in accordance with the present invention, and that other known device connectors may be also used instead of those shown here.

In one example of the present invention, the tension force T (see FIG. 5) necessary to separate the connector 116 according to the present invention is less than the axial tension necessary to pull first device connector 210 out from engagement with a socket on console 102. This helps to ensure that the connector separates at a force below that which could, for example, damage the first device connector.

However, in an alternative arrangement, the axial separation force of the breakaway safety connector 116 is less than that between the first device connector 210 and console 102. For example, in the situation illustrated in FIG. 4, cable 106*a*' is pulled at an angle relative to the axial direction of engagement between the connector 116 and the console 102 (i.e., "off-axis"). This off-axis force causes oblique loading on the cable/console connection, which increases the force needed to disconnect the cable 106*a*' and console 102. If the angle of the applied force is more than a few degrees, it may be effectively impossible to disconnect the cable 106*a*' from the console 102 because of the oblique loading. The connector 116 therefore binds, and the axial force required to separate the safety connector 116 can be higher than the axial force needed to disconnect the cable from the console. As an added benefit, one can intentionally apply an axial force (i.e., an on-axis force) between the safety breakaway connector 116 and the input/control unit 104 to disconnect cable 106*a* from console 102.

Additionally, the axial separation force needed to separate the parts of connector 116' is preferably less than the force needed to slide the console 102 across surface 108 on which console 102 rests. This reduces the chance of console 102 moving across (and possibly off of) surface 108. The frictional effects between console 102 and surface 108 can be determined in a known manner in view of the weight of console 102 and the static coefficient of friction between console 102 and surface 108.

In one example of the present invention, the axial separation or "unmating" force required to separate the breakaway connector 116 is preferably between 2 and 5 lbs. Such a setting is desirable to prevent an unintended separation during common video game controller movements during game play while preventing damage from unintended external forces. However, it is recognized that the connector 116 may be designed to separate or "unmate" at any desired force beneficial for the application.

It is noted that an input/controller device 104 may be provided with its own cable and connector for direct connection with console 102. Accordingly, a cable 106*a*(106*a*') can be separately purchased and later used to provide an intermediate connection between input/controller device 104 and console 102 having the safety functionality provided by connector 116(116'). Conversely, console 102, cable 106*a*(106*a*'), and input/controller device 104 can be sold together as a group.

Thus, while there have been shown and described features of the present invention as applied to preferred embodiments thereof, it will be understood that various omissions and substitutions and changes in the form and details of the devices illustrated, and in their operation, and in the method illustrated and described, may be made by those skilled in the art without departing from the spirit of the invention as broadly disclosed herein.

What is claimed is:

1. A system of coupling an electronic controller to an electronic processing unit, comprising:

a cable having a first cable portion and a second cable portion;

said first cable portion having a first end and an opposed second end, said first end coupled to the electronic controller, and said second end having a first connector;

said second cable portion having a first end and an opposed second end, said first end having a second connector and a second end with a third connector, said third connector being configured to be removably coupleable to said electronic processing unit;

said first connector and said second connector being configured to be removably coupleable to each other and forming a breakaway connection for said cable between said first cable portion and said second cable portion;

said first connector and said third connector being different from each other permitting said first connector to mate with said second connector and permitting said third connector to mate with the electronic processing unit.

2. The system according to claim 1, wherein said first connector, said second connector, and said third connector are configured for permitting bi-directional signal traffic to be transferred between the electronic controller and the electronic processing unit.

3. The system according to claim 1, wherein said electronic processing unit is disposed on a substantially horizontal supporting surface, a separate force required to disconnect said first and second cable portions at said breakaway connection being less than a force needed to slidingly advance said electronic processing unit across said supporting surface.

4. The system according to claim 1, wherein each of the first connector, the second connector, and the third connector is on-axis connectors.

5. The system according to claim 4, wherein a force required to disconnect said first cable portion and second cable portions at said breakaway connection is less than a force needed to disengage said third connector from the electronic processing unit.

6. The system according to claim 4, wherein a breakaway force required to disconnect said first cable portion and said second cable portion at said breakaway connection is less than a force, applied in a direction oblique to a direction along which said third connector and the electronic processing unit are removably coupled, needed to disconnect said third connector from the electronic processing unit.

7. The system according to claim 4, wherein the first connector includes a slot portion configured with a plurality of first conductive members and the second connector includes a complementary protruding portion having a plurality of second conductive members, said slot portion being configured to receive the complementary protruding portion therein so that said first conductive members and said second conductive member are coupled together.

8. The system according to claim 7, wherein the first connector includes an alignment member and the third connector includes a complementary alignment member.

9. The system according to claim 4, wherein said first cable portion further includes a fourth connector disposed at said first end; said fourth connector being configured to be removably coupled with said electronic controller.

10. The system according to claim 9, wherein at least one of said third connector and said fourth connector includes at least a part of a connection locking mechanism, said connection locking mechanism being constructed and arranged to lockingly engage at least one of said third connector and said fourth connector to a respective one of said electronic processing unit and said controller unit.

11. A system having an electronic game controller configured to provide at least control signals to an electronic game processing unit, comprising:

a control cable having a first cable portion and a second cable portion;

said first cable portion having a first end and an opposed second end, said first end coupled to the electronic game controller, and said second end having a first connector;

said second cable portion having a first end and an opposed second end, said first end having a second connector and a second end with a third connector, said third connector being configured to be removably coupleable to said electronic game processing unit;

said first connector and said second connector being configured to be removably coupleable to each other and forming a breakaway connection for said control cable between said first cable portion and said second cable portion, said breakaway connection;

said first connector and said third connector being different from each other permitting said first connector to mate with said second connector and permitting said third connector to mate with the electronic game processing unit.

12. The system according to claim 11, wherein a breakaway force required to decouple said first cable portion and said second cable portion at said breakaway connection is less than a force, applied in a direction oblique to a direction along which said third connector and the electronic game processing unit are removably coupled, needed to decouple said third connector from the electronic game processing unit.

13. The system according to claim 11, wherein the first connector includes a slot portion configured with a plurality of first conductive members being laterally disposed and the second connector includes a complementary protruding portion having a plurality of second conductive members, said slot portion being configured to receive the complementary protruding portion therein so that said first conductive members and said second conductive member are coupled together.

14. The system according to claim 11, wherein the electronic game processing unit is disposed on a substantially horizontal supporting surface in which a separating force required to disconnect said first and second cable portions at said breakaway connection is less than a force needed to slidingly advance said electronic game processing unit across said supporting surface.

15. The system according to claim 11, wherein the first connector, the second connector, and the third connector, respectively are on-axis connectors.

16. The system according to claim 15, wherein a force required to disconnect said first cable portion and second cable portions at said breakaway connection is less than a force needed to disengage said third connector from the electronic processing unit.

17. The system according to claim 15, wherein said first connector, said second connector, and said third connector are configured for permitting bi-directional control signal traffic to be transferred between the electronic game controller and the electronic game processing unit.

18. The system according to claim 15, wherein said first cable portion further includes a fourth connector disposed at said first end; said fourth connector being configured to be removably coupled with said electronic game controller.

19. The system according to claim 18, wherein at least one of said third connector and said fourth connector includes at least a part of a connection locking system, said connection locking system being constructed and arranged to lockingly engage at least one of said third connector and said fourth connector to a respective one of said electronic game processing unit and said electronic game controller.

20. A system including an electronic video game controller configured to transmit input data to an electronic video game unit, comprising:

a cable having a first cable portion and a second cable portion; said cable configured to transmit at least said input data between the electronic video game controller and the electronic video game unit;

said first cable portion having a first end and an opposed second end, said first end coupled to the electronic video game controller, and said second end having a first breakaway connector;

said second cable portion having a first end and an opposed second end, said first end having a second breakaway connector and a second end with a third connector, said third connector being configured to be removably coupleable to said electronic video game unit;

said first breakaway connector and said second breakaway connector being configured to be selectively releaseable with respect to each other and forming a breakaway connection of said cable between said first cable portion and said second cable portion, said breakaway connection being responsive to a separating force applied at least one of said first cable portion and said second cable portion; said first breakaway connector and said third connector being different from each other permitting said first breakaway connector to be selectively releaseble with said second breakaway connector and permitting said third connector to mate with the electronic video game unit, said first breakaway connector being non-mating with the electronic video game unit.

21. The system according to claim 20, wherein the first connector includes a slotted receiving portion configured with a plurality of first conductive members being laterally disposed and the second connector includes a complementary protruding portion having a plurality of second conductive members, said receiving portion being configured to receive the complementary protruding portion therein so that said first conductive members and said second conductive member are coupled together.

22. The system according to claim 21, wherein said first cable portion further includes a fourth connector disposed at said first end; said fourth connector being configured to be removably coupled with said electronic video game controller; wherein at least one of said third connector and said fourth connector includes at least a part of a connection locking mechanism, said connection locking mechanism being constructed and arranged to lockingly engage at least one of said third connector and said fourth connector to a respective one of said electronic video game unit and said electronic video game controller.

* * * * *